US007117805B2

(12) United States Patent
Shackelford, Jr.

(10) Patent No.: US 7,117,805 B2
(45) Date of Patent: Oct. 10, 2006

(54) BOAT LIFT

(75) Inventor: Francis H. Shackelford, Jr., Hookerton, NC (US)

(73) Assignee: Tide Tamer Industries, Inc., Snow Hill, NC (US)

( * ) Notice: Subject to any disclaimer, the term of this patent is extended or adjusted under 35 U.S.C. 154(b) by 0 days.

(21) Appl. No.: 11/154,491

(22) Filed: Jun. 15, 2005

(65) Prior Publication Data

US 2005/0274311 A1 Dec. 15, 2005

Related U.S. Application Data

(60) Provisional application No. 60/579,868, filed on Jun. 15, 2004.

(51) Int. Cl.
*B63C 3/06* (2006.01)

(52) U.S. Cl. ..... 114/44; 405/3

(58) Field of Classification Search ..... 114/44–48; 405/3, 1, 4; 414/678
See application file for complete search history.

(56) References Cited

U.S. PATENT DOCUMENTS 3,034,767 A 5/1962 Gordon
5,211,124 A 5/1993 Reiser
5,772,360 A * 6/1998 Wood, II ..... 405/3
5,810,508 A 9/1998 Norfolk et al.
5,839,851 A * 11/1998 Norfolk et al. ..... 405/3
5,957,623 A 9/1999 Sargent et al.
5,970,813 A 10/1999 Parkins et al.
6,021,692 A 2/2000 Norfolk et al.
6,033,148 A 3/2000 Norfolk et al.
6,122,994 A 9/2000 Norfolk et al.
6,397,691 B1 6/2002 Greene
6,408,776 B1 * 6/2002 McLaughlin et al. ..... 114/44
6,435,768 B1 * 8/2002 Mansfield ..... 405/3
6,470,816 B1 * 10/2002 Golden et al. ..... 114/44
2004/0035343 A1 2/2004 Floe et al.

* cited by examiner

*Primary Examiner*—Ajay Vasudeva
(74) *Attorney, Agent, or Firm*—Myers Bigel Sibley & Sajovec, P.A.

(57) ABSTRACT

A boat lift of the type that is mounted on the pilings of a boat slip or dock having four pilings placed in a rectangular arrangement is provided. The boat lift includes a cradle upon which the hull of a boat is adapted to rest. A structure for raising and lowering the cradle is provided and a cable connects the cradle to the structure for raising and lowering the cradle. A drive unit is operatively associated with the structure for raising and lowering the cradle and includes a motor having an output shaft adapted to drive the drive unit such that upon operation of the motor, the cradle is raised or lowered.

2 Claims, 7 Drawing Sheets

BOAT LIFT

PRIOR APPLICATION

This application claims priority from U.S. Provisional Patent Application Ser. No. 60/579,868 filed Jun. 15, 2004.

FIELD OF THE INVENTION

This invention relates generally to the field of boat lifts and more particularly to boat lifts for lowering watercraft into the water for use and lifting them out of the water for storage.

BACKGROUND OF THE INVENTION

Owners of boats that are stored in the water at docks know that this is a less than ideal situation. For example, during storms the boat can sustain damage as the result of being banged against the dock as the result of high wind velocity or storm surge. In addition, boats that are stored in the water experience increased maintenance costs due to the need for more frequent hull painting, floating objects striking the hull and growth of crustaceans on the hull which must be removed.

In view of the foregoing, it is self-evident that storage of the boat out of the water would have significant benefits. In response to this need, there are boat yards that will store the boat on land in a cradle or in a warehouse and will, upon demand using a forklift or cradle type crane, place the boat in the water for the owner. However, this alternative is expensive and on high usage days, there may be a delay due to prior requests.

It will therefore be seen that a self-contained system of storing the boat out of the water at it's own slip at the dock would be a significant improvement over the prior art.

In view of the foregoing, it is an object of the invention to provide an improved boat lift that overcomes the drawbacks and deficiencies of the prior art devices.

Another object of the present invention is to provide an improved boat lift that is reliable.

Still another object of the present invention is to provide an improved boat lift that economical.

Yet another object of the present invention is to provide an improved boat lift that is safe and easy to operate.

A further object of the present invention is to provide an improved boat lift that is operable on demand at the slip location.

Other objects, features and advantages of the invention will appear in the course of the following description.

SUMMARY OF THE INVENTION

The invention is directed to a boat lift of the type that is mounted on the pilings of a boat slip or dock having four pilings placed in a rectangular arrangement. The boat lift comprises in combination, a cradle upon which the hull of a boat is adapted to rest. A means for raising and lowering the cradle is provided and a cable connects the cradle to the means for raising and lowering the cradle. A drive unit is operatively associated with the means for raising and lowering the cradle and includes a motor having an output shaft adapted to drive the drive unit such that upon operation of the motor, the cradle is raised or lowered.

DESCRIPTION OF THE DRAWINGS

The drawings illustrate the best mode presently contemplated of carrying out the invention.

In the drawings.

DETAILED DESCRIPTION OF THE ILLUSTRATED EMBODIMENT

While the present invention will be described more fully hereinafter, it is to be understood at the outset that persons of skill in the art may modify the invention herein described while still achieving the favorable results of this invention. Accordingly, the description which follows is to be understood as being a broad teaching disclosure directed to persons of skill in the appropriate arts, and not as limiting upon the present invention.

Figure 1:
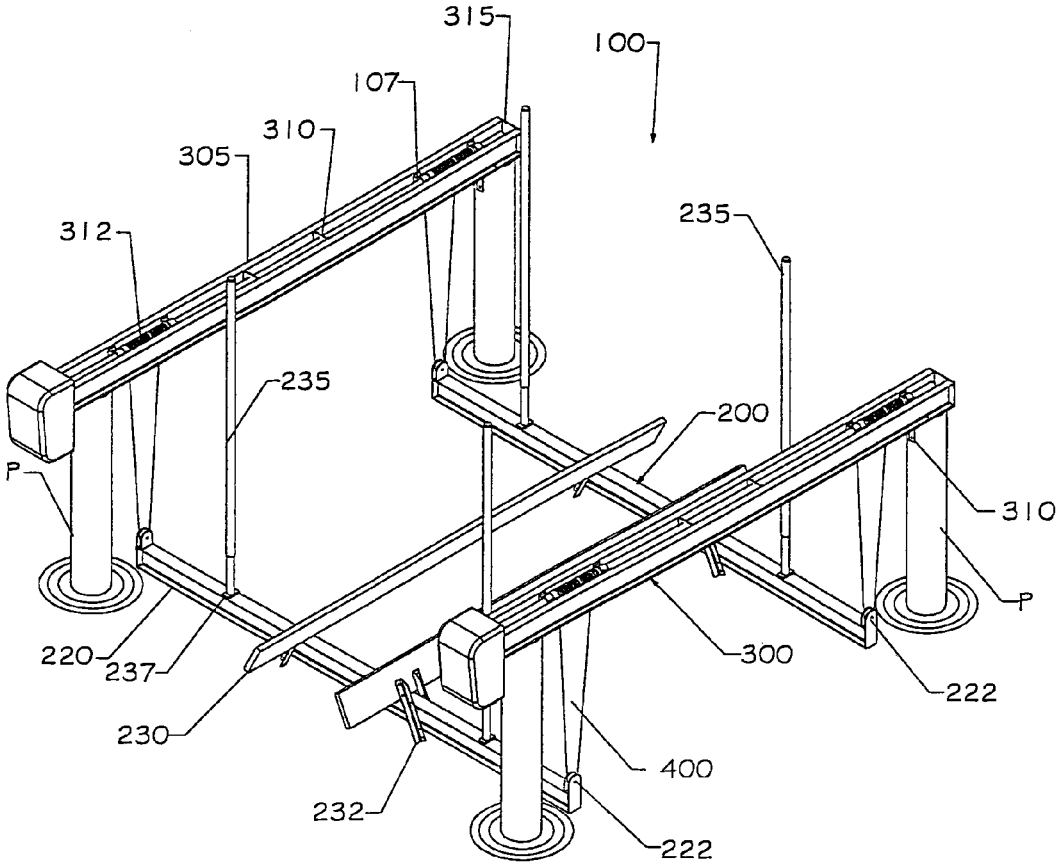
FIG. 1 is a perspective view of a boat lift installed at a slip location.
Figure 2:
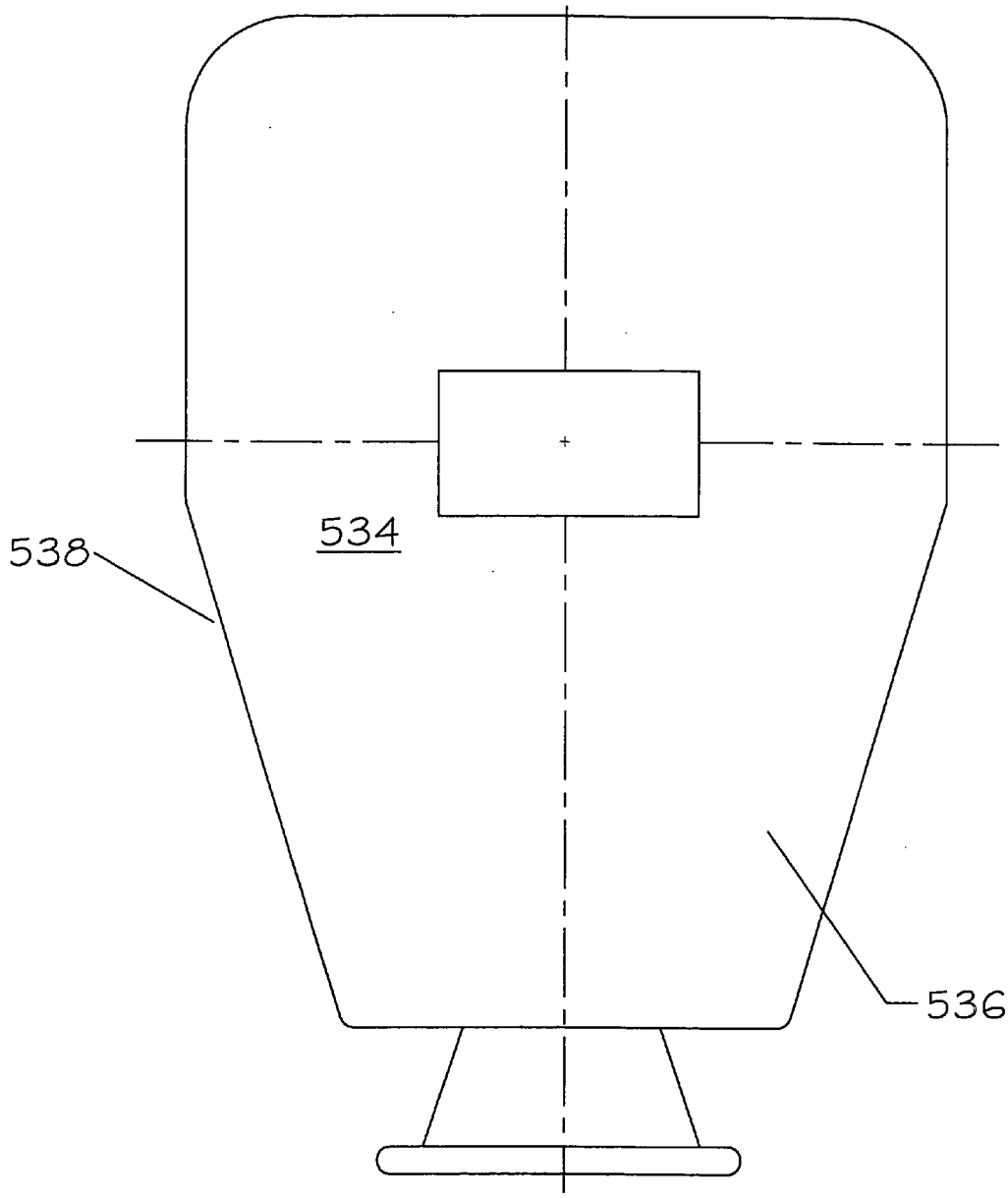
FIG. 2 is a left side view of the drive unit according to the present invention.
Figure 3:
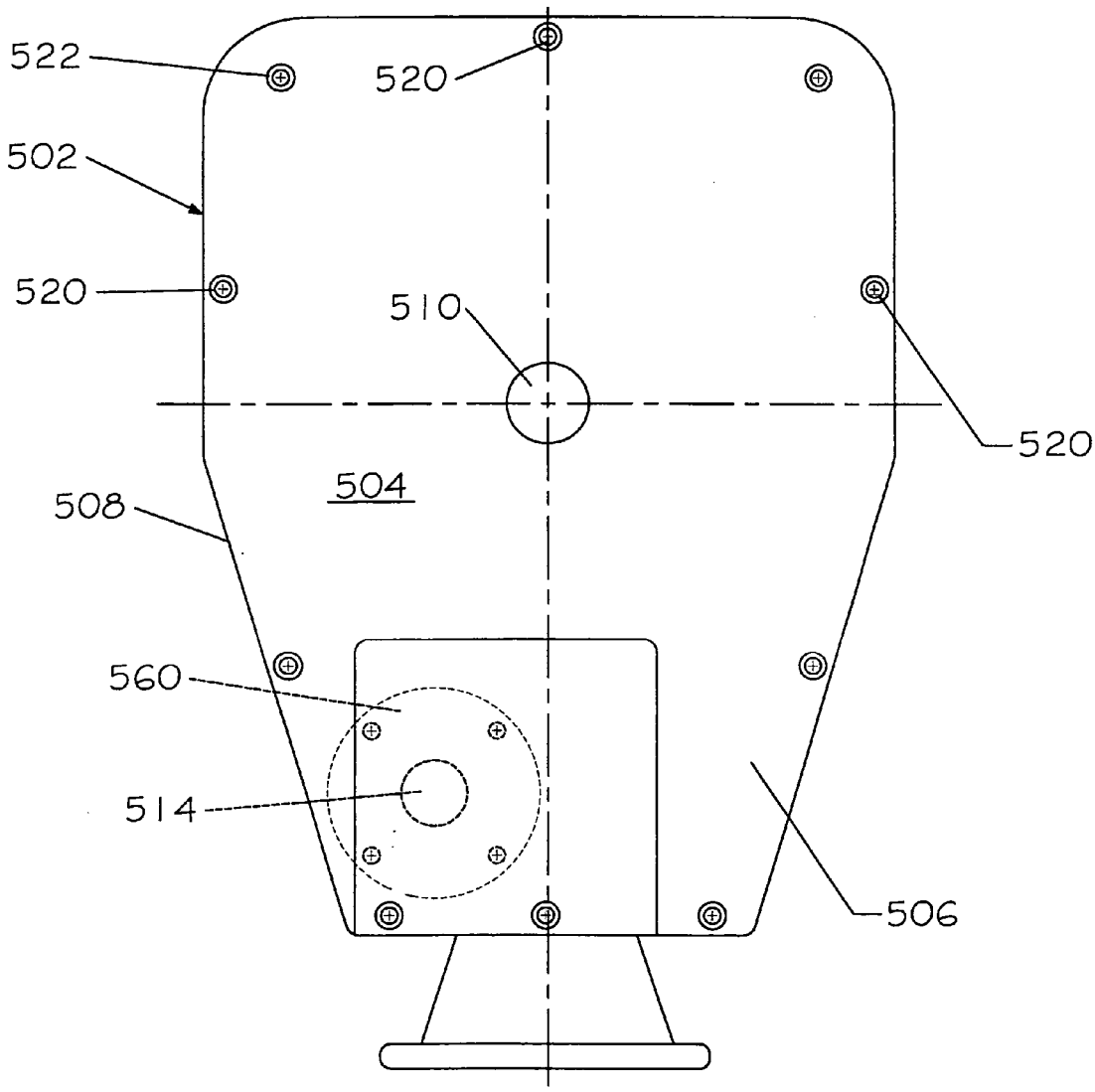
FIG. 3 is a right side view of the drive unit according to the present invention.

Referring more specifically to the drawings, and particularly to FIG. 1, a boat slip is schematically illustrated. Four pilings P (i.e., wooden or cement) are rectangularly spaced in the water W and collectively define the slip area. A floating platform by which the slip would be reached is located alongside at least on pair of the pilings P. The boat lift is generally indicated at 100 comprises a cradle 200, a means for raising and lowering the cradle 300, a cable 400, a drive unit 500 and a motor 600. Unless otherwise stated herein, all materials are aluminum although other rust proof materials may be substituted such as stainless or galvanized steel. In some cases, where the boat to be stored is small or light, plastics may also be employed.

The cradle 200 includes a pair of cradle beams 220 that are positioned between and extend across the width of the slip as shown in FIG. 1. At each end of the respective cradle beams is a pulley 222, the illustrated embodiment having four such pulleys. In addition, a pair of bunk boards 230 are mounted via suitable means such as brackets 232 between each of the cradle beams 220. The bunk boards 230 are usually made of wood or other relatively soft smooth material and can be covered with carpet or artificial turf (not shown) which will not scratch the underside of the boat hull. A pair of locator poles 235 are connected to opposite sides of the cradle beam 220 via suitable means such as brackets 237 and are fabricated from flexible PVC pipe or other material which will not damage the boat hull. The locator poles 235 serve to direct the captain of the boat where to drive the boat to ensure proper location of the hull between the bunk boards 230.

A means for raising and lowering the cradle 200 is provided in the form of a pair of overhead beams 305 which are attached to pilings P at their respective ends. The overhead beams rest atop the pilings and are connected thereto via suitable means such as brackets 310 and screws (not shown) or may attached directly to the piling using bolts or screws, depending upon the piling material. The overhead beams 305 comprise a pair of I-beams that are held in spaced relation by means of spacer brackets 310. A pipe 312 is mounted for rotation within the overhead beams 305. Pipe 312 is threaded proximate both of its ends, as will be explained in greater detail herein below. The overhead beams include end covers 315 at each end. One end cover 315 of each overhead beam 305 includes a hole defining an opening which renders the end of pipe 312 accessible and proximate the accessible end are a pair of openings 320 located on opposite sides of pipe 312.

A cable 400 connects the cradle 200 to the means for raising and lowering the cradle 300. In the illustrated embodiment there are four such cables, however, in the discussion that follows, reference will be made to one cable. The cable 400 is connected at one end to the pipe 312 by conventional means, well known to those skilled in the art, runs through pulley 222 and then back up to pipe 312 where the opposite cable end is connected. The cable 400 is connected such that when pipe 312 rotates, it is wound onto the threaded portion.

A drive unit 500 for raising and lowering the cradle 200 comprises a housing 502 having a first cast housing section 504 that includes a bottom wall section 506 surrounded by upstanding side walls 508. Located in the central section of the bottom wall 506 is a hole defining opening 510 through which a drive shaft (to be discussed in detail herein below) may extend. In addition, first housing section includes a bearing journal 512 associated with opening 510 which is adapted to receive a low friction bushing 511 manufactured from Teflon®, Nylon®, Orkot®, or other similar material. A second hole defining opening 514 is located in the lower portion of the housing 502 and is adapted to receive the output shaft of a motor, to be described. Opening 514 includes a bearing journal 516 and a low friction bushing 518 similar to that described herein above. Housing 502 also includes a plurality of openings 520 in which are received a plurality of screws 522 or other similar fastening means which unite the respective first and second housing sections. Internal ribbing may be added to the housing for strength as needed.

A second housing section 534 is provided and includes a bottom wall section 536 surrounded by upstanding side walls 538. Housing section 534 includes a centrally located bearing journal which is designed as the opposing half of bearing journal 512 and a bushing 511 as stated above. Further, additional structural reinforcing ribbing is provided as needed as are screw openings 540 which correspond to openings 520 so that when the second housing section 534 overlies the first housing section 502, a chamber 542 is defined.

Mounted within chamber 542 in bearing journal 512 is a large circular sprocket which mounts in its center a shaft 552. The sprocket 550 is positioned within housing 502 such that shaft 552 extends through opening 510 in the bottom wall 506. The shaft 552 is adapted to slide into the accessible end of pipe 312. Openings 320 and 554 are aligned and a bolt (not shown) is inserted therein to connect the shaft 552 to pipe 312. The bolt is maintained in place by conventional means such as, for example, a cotter pin.

A smaller sprocket 560 having a shaft 562 is positioned within bearing journal 516 adjacent sprocket 550. The shaft is connected to a motor 600 having an output shaft adapted to drive the drive unit. The gear shaft and the motor shaft are connected via conventional means, well known to those skilled in the art. A drive chain 575 is mounted so as to surround both the large sprocket 550 and the smaller sprocket 560 which are mounted for rotation between the respective bottom walls 506 and 536. Upon rotation of the motor shaft, the smaller sprocket 560 rotates causing the drive chain 575 to move, thus rotating the large sprocket 550 and its corresponding shaft which then rotates the pipe. Rotation of the pipe winds (or unwinds) the cable, thus raising (or lowering) the cradle. Electricity is provided to the motor by wiring from the dock. A control panel (not shown) with an up/down/stop switch is connected to the motor.

Figure 4:
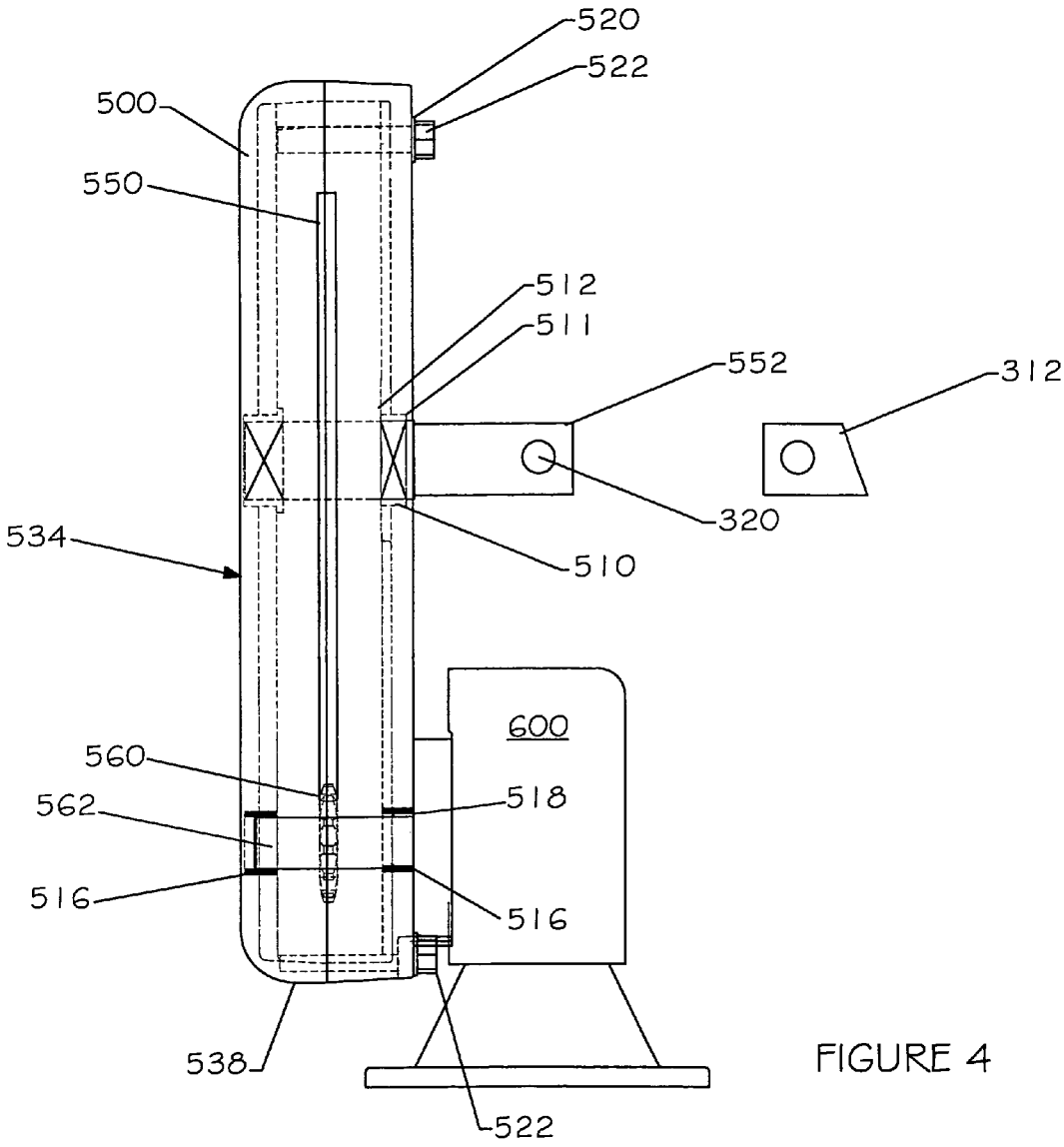
FIG. 4 is an end view of the drive unit according to the present invention.
Figure 5:
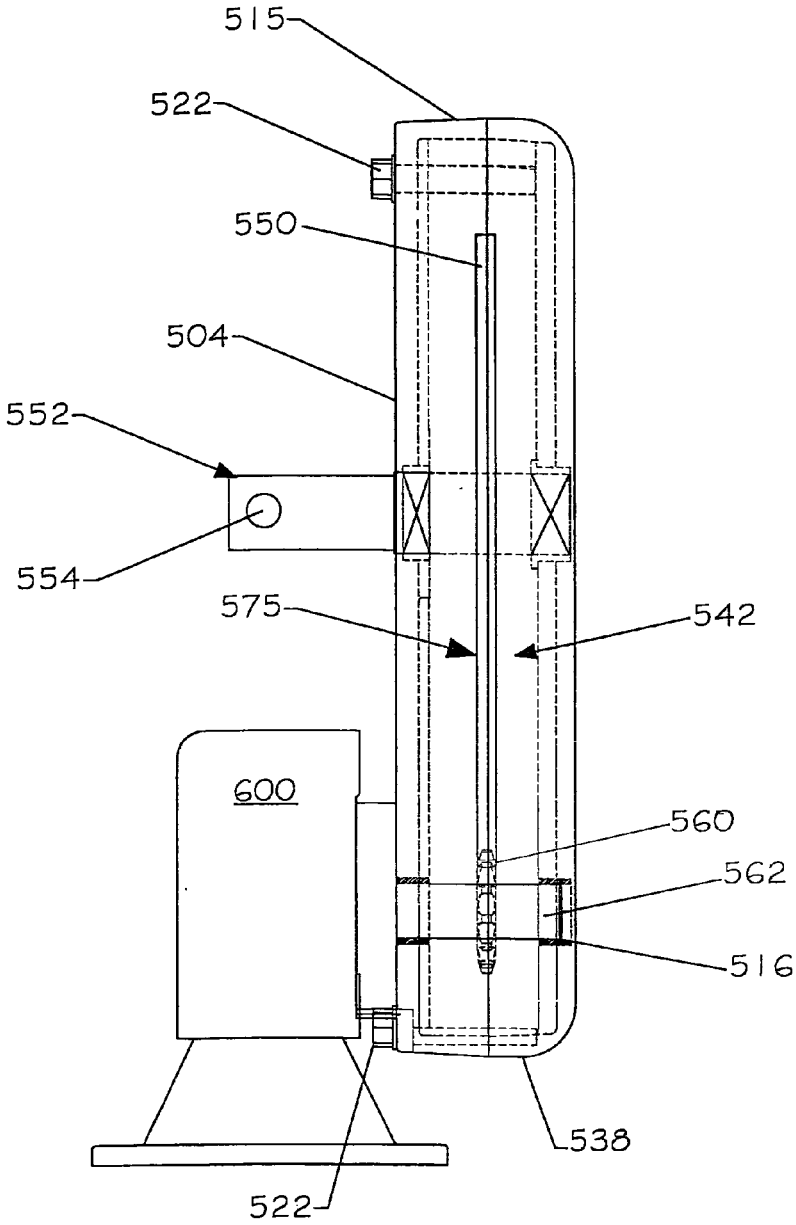
FIG. 5 is an end view of the drive unit according to the present invention.
Figure 6:
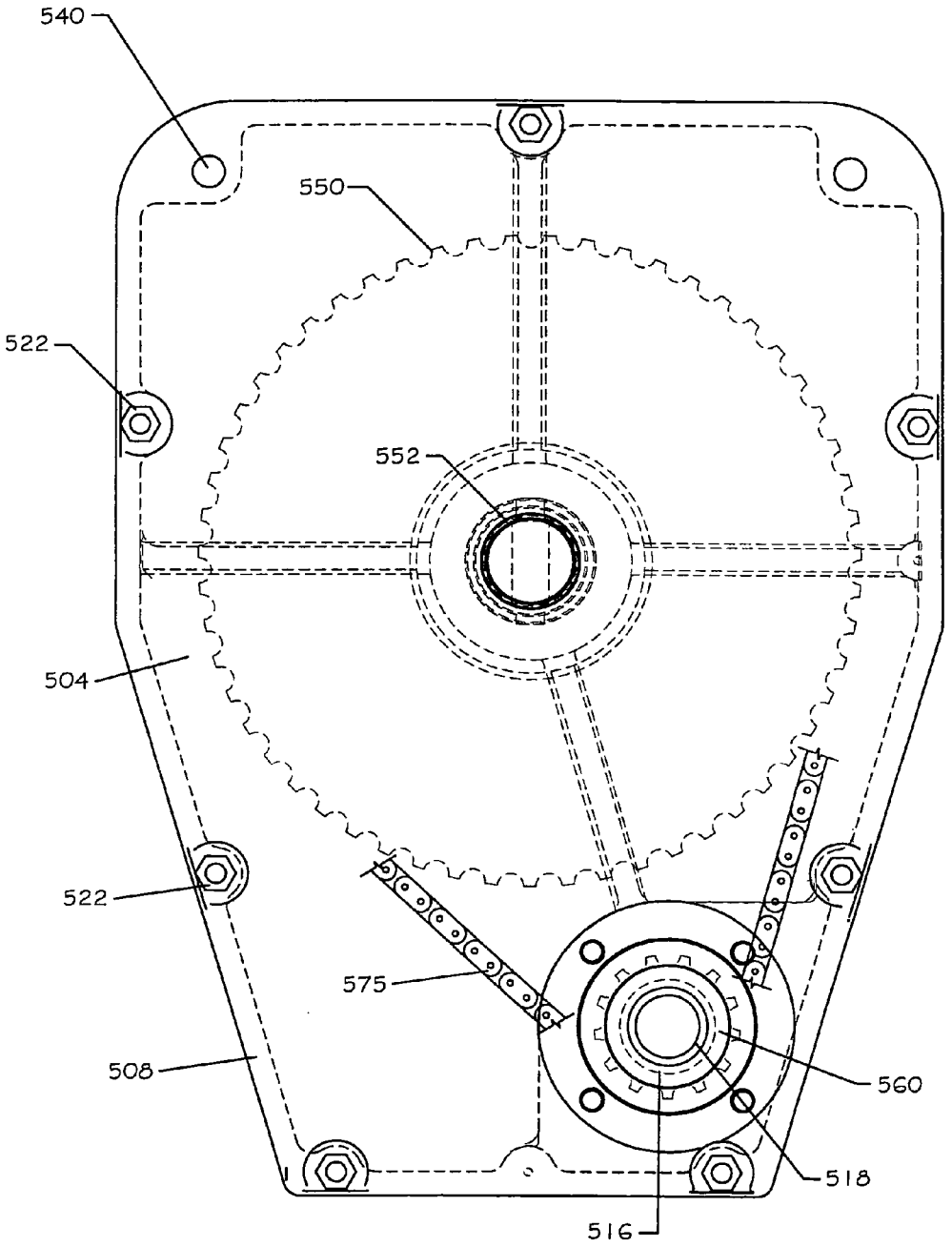
FIG. 6 is a plan view of means for raising and lowering the cradle according to the present invention.
Figure 7:
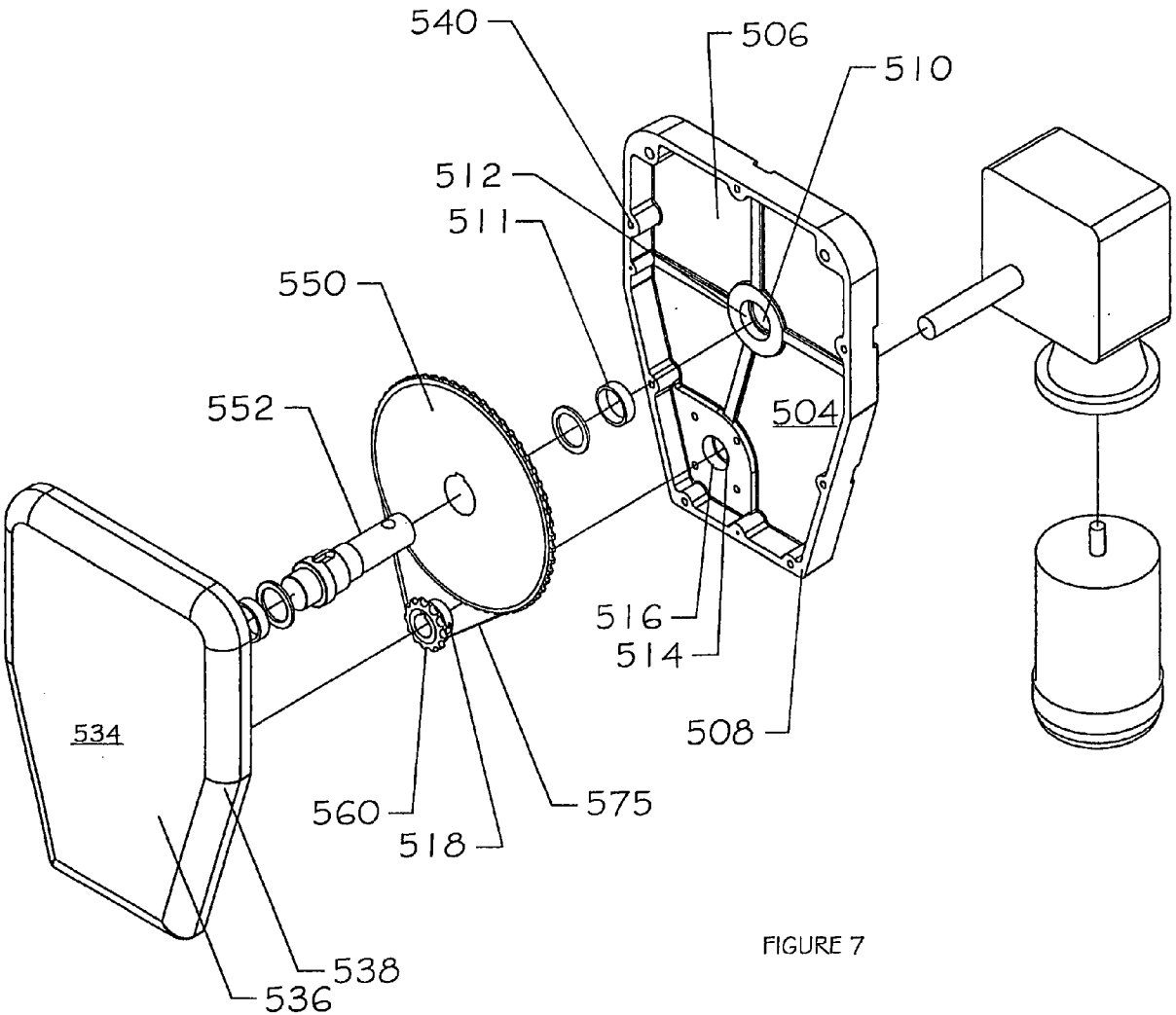
FIG. 7 is an exploded view of the means for raising and lowering the cradle according to the present invention.

To summarize the foregoing description, according to embodiments of the present invention, a boat lift 100 for raising and lowering a boat having a hull includes a cradle 200 adapted to receive the boat such that the hull of the boat rests on the cradle and means 300 for raising and lowering the cradle. A cable 400 connects the cradle to the means for raising and lowering the cradle. A drive unit 500 is operatively associated with the means for raising and lowering the cradle and a motor 600 having an output shaft 562 is adapted to drive the drive unit 500. Upon operation of the motor 600, the cradle 200 may be raised and lowered. The drive unit 500 includes a housing 502 defining a substantially fully enclosed chamber 542. The housing 502 is formed of at least one of aluminum, stainless steel, and galvanized steel and includes first and second cast housing sections 504, 534 bolted together and defining the enclosed chamber 542. A first sprocket 550 is disposed in the enclosed chamber 542 and is rotatable about a first axis. The first sprocket 550 is detachably joined to the means 300 for raising and lowering the cradle (for example, by a bolt inserted through aligned holes 320, 554 as described herein and shown in FIG. 4). A second sprocket 560 is disposed in the enclosed chamber 542 and is rotatable about a second axis that is substantially parallel to the first axis (as shown in FIGS. 4–7). The second sprocket 560 is joined to the output shaft 562 of the motor 600. The first and second sprockets 550, 560 are substantially co-planar (as shown in FIGS. 4 and 5). A drive chain 575 is disposed in the enclosed chamber 542 and extends between and about each of the first and second sprockets 550, 560 to transfer a drive force from the second sprocket 560 to the first sprocket 550. A drive shaft 552 is disposed in the enclosed chamber 542 and the first sprocket 550 is mounted on the drive shaft 552. The housing 502 includes first and second opposed walls 506, 536 disposed on opposed sides of the first sprocket 550. The first wall 506 includes a drive shaft opening 510 and an output shaft opening 514 and the second wall 536 includes a drive shaft recess and an output shaft recess (as shown in FIGS. 4 and 5). The drive shaft 552 extends through the drive shaft opening 510 and into the drive shaft recess such that the drive shaft 552 is rotatably supported by the first and second walls 506, 536 of the housing 502. The output shaft 562 extends through the output shaft opening 514 and into the output shaft recess such that the output shaft 562 is rotatably supported by the first and second walls 506, 536 of the housing 502. The boat lift 100 further includes a respective journal 512 formed about each of the drive shaft opening and the drive shaft recess, a respective low friction bushing 511 mounted in each of the journals formed about the drive shaft opening and the drive shaft recess, a respective journal 516 formed about each of the output shaft opening and the output shaft recess, and a respective low friction bushing 518 mounted in each of the journals formed about the output shaft opening and the output shaft recess (see, for example, FIGS. 4 and 5).

According to some embodiments, the means 300 for raising and lowering the cradle includes a pipe 312 detachably joined to the drive shaft 552 and the drive shaft and the pipe are rotatable about a common axis (see FIG. 4). The drive shaft 552 and the pipe 312 each include a pair of opposed transverse holes 320, 554 formed therein. One of the drive shaft 552 and the pipe 312 is axially received in the other such that the transverse holes 554 of the drive shaft 552 are aligned with the transverse holes 320 of the pipe 312. A bolt extends through the transverse holes 554 of the drive shaft 552 and the transverse holes 320 of the pipe 312 to detachably secure the drive shaft 552 to the pipe 312.

Various modes of carrying out the invention are contemplated as being within the scope of the following claims particularly pointing out and distinctly claiming the subject matter which is regarded as the invention.

The invention claimed is:

1. A boat lift supported on a piling in a body of water for raising and lowering a boat having a hull, the boat lift comprising:

a cradle adapted to receive the boat such that the hull of the boat rests on the cradle;

means for raising and lowering the cradle;

a cable connecting the cradle to the means for raising and lowering the cradle;

a drive unit operatively associated with the means for raising and lowering the cradle; and a motor having an output shaft adapted to drive the drive unit;

whereby upon operation of the motor, the cradle is raised or lowered; wherein the drive unit includes:

a housing defining a substantially fully enclosed chamber, wherein the housing is formed of at least one of aluminum, stainless steel, and galvanized steel and includes first and second cast housing sections bolted together and defining the enclosed chamber;

a first sprocket disposed in the enclosed chamber and rotatable about a first axis, wherein the first sprocket is detachably joined to the means for raising and lowering the cradle;

a second sprocket disposed in the enclosed chamber and rotatable about a second axis that is substantially parallel to the first axis, wherein the second sprocket is joined to the output shaft of the motor, wherein the first and second sprockets are substantially co-planar;

a drive chain disposed in the enclosed chamber and extending between and about each of the first and second sprockets to transfer a drive force from the second sprocket to the first sprocket; and a drive shaft disposed in the enclosed chamber and upon which the first sprocket is mounted; wherein:

the housing includes first and second opposed walls disposed on opposed sides of the first sprocket, the first wall including a drive shaft opening and an output shaft opening and the second wall including a drive shaft recess and an output shaft recess; and the drive shaft extends through the drive shaft opening and into the drive shaft recess such that the drive shaft is rotatably supported by the first and second walls of the housing; and the output shaft extends through the output shaft opening and into the output shaft recess such that the output shaft is rotatably supported by the first and second walls of the housing; and wherein the boat lift further includes:

a respective journal formed about each of the drive shaft opening and the drive shaft recess;

a respective low friction bushing mounted in each of the journals formed about the drive shaft opening and the drive shaft recess;

a respective journal formed about each of the output shaft opening and the output shaft recess; and a respective low friction bushing mounted in each of the journals formed about the output shaft opening and the output shaft recess.

2. The boat lift of claim 1 wherein:

the means for raising and lowering the cradle includes a pipe detachably joined to the drive shaft;

the drive shaft and the pipe are rotatable about a common axis;

the drive shaft and the pipe each include a pair of opposed transverse holes formed therein;

one of the drive shaft and the pipe is axially received in the other such that the transverse holes of the drive shaft are aligned with the transverse holes of the pipe; and the boat lift further includes a bolt extending through the transverse holes of the drive shaft and the transverse holes of the pipe to detachably secure the drive shaft to the pipe.

* * * * *